US012742327B2

(12) United States Patent
Robinson et al.

(10) Patent No.: US 12,742,327 B2
(45) Date of Patent: Sep. 22, 2026

(54) ADJUSTABLE STAIR RAILING POST ASSEMBLY

(71) Applicant: PrimeSource Building Products, Inc., Irving, TX (US)

(72) Inventors: Collin Michael Robinson, Garland, TX (US); Kevin Brady Flatt, Dallas, TX (US); Kevin Troy Burt, Dallas, TX (US)

(73) Assignee: PrimeSource Building Products, Inc., Irving, TX (US)

( * ) Notice: Subject to any disclaimer, the term of this patent is extended or adjusted under 35 U.S.C. 154(b) by 137 days.

(21) Appl. No.: 18/833,746

(22) PCT Filed: Feb. 3, 2023

(86) PCT No.: PCT/US2023/012338

§ 371 (c)(1),
(2) Date: Jul. 26, 2024

(87) PCT Pub. No.: WO2023/150308

PCT Pub. Date: Aug. 10, 2023

(65) Prior Publication Data

US 2025/0146292 A1 May 8, 2025

Related U.S. Application Data

(60) Provisional application No. 63/306,991, filed on Feb. 4, 2022.

(51) Int. Cl.

| | |
|---|---|
| ***E04F 11/18*** | (2006.01) |
| ***E04F 11/025*** | (2006.01) |
| *E04F 11/02* | (2006.01) |

(52) U.S. Cl.

CPC ..... *E04F 11/1834* (2013.01); *E04F 11/025* (2013.01); *E04F 2011/0209* (2013.01); *E04F 2011/1889* (2013.01)

(58) Field of Classification Search

CPC . E04F 11/025; E04F 11/0255; E04F 11/1834; E04F 2011/0209; E04F 2011/1889

(Continued)

(56) References Cited

U.S. PATENT DOCUMENTS 624,782 A * 5/1899 Fuchs ..... E06C 1/387 182/1
1,316,155 A * 9/1919 Harrison et al. ..... E04F 11/181 403/174

(Continued)

FOREIGN PATENT DOCUMENTS

CN 201033946 Y 3/2008

OTHER PUBLICATIONS

International Search Report and Written Opinion in International PCT App. No. PCT/US2023/012338 dated Apr. 14, 2023, 8 pages.

*Primary Examiner* — James M Ference
(74) *Attorney, Agent, or Firm* — Foley & Lardner LLP

(57) ABSTRACT

An angle-adjustable post assembly for supporting a rail panel on a stairway includes a post portion that is a generally hollow rectangular tube and a pivot rod that extends laterally from the post portion. The pivot rod is cylindrical to allow pivoting adjustment to position the post portion in a vertical orientation for multiple incline angles. The angle-adjustable post assembly also includes a base portion defining a plurality of first through holes, each of which is configured to receive a first fastener. A top bracket with an arcuate portion that is sized and shaped to correspond to the circumference of the pivot rod defines a pair of second through holes, each configured to receive a second fastener.

20 Claims, 6 Drawing Sheets

(58) Field of Classification Search
USPC ..... 52/182, 183, 184
See application file for complete search history.

(56) References Cited

U.S. PATENT DOCUMENTS 1,772,159 A * 8/1930 Roth ..... E04F 11/1834 256/67
2,427,723 A * 9/1947 Hawkins ..... E04F 11/1834 256/72
2,867,855 A * 1/1959 Xanten ..... E04F 11/025 182/228.3
3,026,080 A * 3/1962 Thurnauer ..... E04F 11/1804 256/65.03
3,150,742 A * 9/1964 Carter ..... E04F 11/0255 182/93
3,379,414 A * 4/1968 Thurnauer ..... E04F 11/181 403/389
3,480,257 A * 11/1969 Bourn ..... E04G 5/045 182/113
3,511,477 A * 5/1970 Seery ..... E04F 11/1812 256/69
3,626,438 A * 12/1971 Cornell ..... E04F 11/0255 52/191
4,053,140 A * 10/1977 Clemens ..... E04F 11/181 403/233
4,150,907 A * 4/1979 Thurnauer ..... F16B 12/40 403/191
4,457,398 A * 7/1984 Loix ..... E04F 11/1041 182/151
4,527,366 A * 7/1985 Greene ..... E04F 11/025 182/83
4,928,930 A * 5/1990 Chung ..... E04F 11/1834 403/116
4,948,100 A * 8/1990 Stevens ..... E04F 11/1863 256/65.14
4,959,935 A * 10/1990 Stob ..... E06C 1/387 182/156
5,437,433 A * 8/1995 Rezek ..... E04F 11/1834 256/67
5,527,016 A * 6/1996 Wilkerson, Jr. ..... E04F 21/00 52/64
5,907,935 A * 6/1999 Elena ..... E04F 11/035 52/182
6,029,954 A * 2/2000 Murdaca ..... E04F 11/1851 256/65.14
7,077,386 B1 * 7/2006 Gray, Jr ..... E04F 11/1834 256/65.03
7,540,472 B2 * 6/2009 Striebel ..... E04F 11/1817 256/65.15
8,919,060 B1 * 12/2014 Oliver ..... E02D 27/48 405/230
8,936,233 B1 * 1/2015 Sneith ..... E04F 11/1812 256/67
9,169,651 B1 * 10/2015 Wynne ..... E04F 11/1812
10,889,993 B2 * 1/2021 Bianchi ..... E04F 11/062
2008/0163571 A1 * 7/2008 Kohler ..... E04F 11/04 248/220.22
2008/0190049 A1 * 8/2008 Muti ..... E04G 27/00 52/183
2009/0212271 A1 * 8/2009 Platt ..... E04F 11/1817 256/65.03
2009/0272957 A1 * 11/2009 Nelson ..... E04F 11/1834 256/65.01
2009/0278106 A1 * 11/2009 Truckner ..... E04F 11/1834 256/65.01
2011/0272659 A1 * 11/2011 Gutierrez ..... E04G 21/3204 256/68
2014/0054530 A1 * 2/2014 Petta ..... E04H 17/1417 256/67
2025/0146292 A1 * 5/2025 Robinson ..... E04F 11/025

* cited by examiner

ADJUSTABLE STAIR RAILING POST ASSEMBLY

PRIORITY CLAIM

This application is a U.S. national phase application under 35 U.S.C. § 371 of International Application No. PCT/US2023/012338, filed on Feb. 3, 2023, which claims priority to U.S. Provisional Patent Application Ser. No. 63/306,991, filed on Feb. 4, 2022, and entitled Adjustable Stair Railing Post Assembly, the disclosures of both of which are hereby incorporated by reference.

BACKGROUND

Stair handrails may require a high level of skill and expertise to assemble. Each handrail post must be precisely positioned relative to the inclined stair stringer to ensure that the posts remain perpendicular to the ground regardless of the angle of incline of the stairs. The present disclosure provides a stair system that may be easier to construct and may be more versatile in allowing stairway construction at multiple incline angles with the same components.

SUMMARY OF THE INVENTION

One embodiment of an angle-adjustable post assembly for supporting a rail panel for a stairway includes a post portion that is a generally hollow rectangular tube and a pivot rod that extends laterally from the post portion. The pivot rod is cylindrical to allow pivoting adjustment to position the post portion in a vertical orientation for multiple incline angles. The angle-adjustable post assembly also includes a base portion defining a plurality of first through holes, each of which is configured to receive a first fastener. A top bracket with an arcuate portion that is sized and shaped to correspond to the circumference of the pivot rod defines a pair of second through holes, each configured to receive a second fastener.

In other embodiments, a reinforcing member that is sized to fit within the cavity of the post member is secured to the top wall of the base portion.

In another embodiment, the system includes a spacer member disposed proximate to the base portion.

Another embodiment includes a stop member secured to the pivot member.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Home owners enjoy outdoor living spaces, such as outdoor decks. Deck frames may be constructed of wood or metal, for example light gauge steel. Stairways may be constructed to allow access to elevated outdoor deck areas. Such stairways may include handrails for increased safety. Stairways are constructed with a variety of rise angles, also referred to as incline angles, pitch angles, stair angles or similar terms. A typical stairway may have an incline angle measured from the horizontal of 30-50 degrees. Building codes and other regulations may govern stairways to ensure that they are constructed to be safely and comfortably ascended and descended. As an example, it is common to have a stair rise of 7-8 inches and a stair tread depth of 10-11 inches. Angles corresponding to these stair rises and depths are in a range of 32-39 degrees measured from the horizontal.

The width of a stairway is another parameter that may be governed by one or more building codes or other regulations. As an example, it is advisable that the horizontal space between railings of a stairway is at least 36 inches. This horizontal space is the un-obstructed horizontal distance or space through which an upper body of an individual ascending or descending the stairway passes. Posts to support a railing panel may be mounted directly to the stair tread surface. However, if increased horizontal space is desired, the railing panel support posts may be mounted directly to the stringers that support the stair treads.

In constructing a stairway, it is desirable to use similarly designed rail panels, posts, and stair stringers to construct safe and comfortable stairways at multiple different incline angles. This is particularly true if the stairway is to be constructed of metal and the construction does not include custom welding at the job site.

Figure 1A:
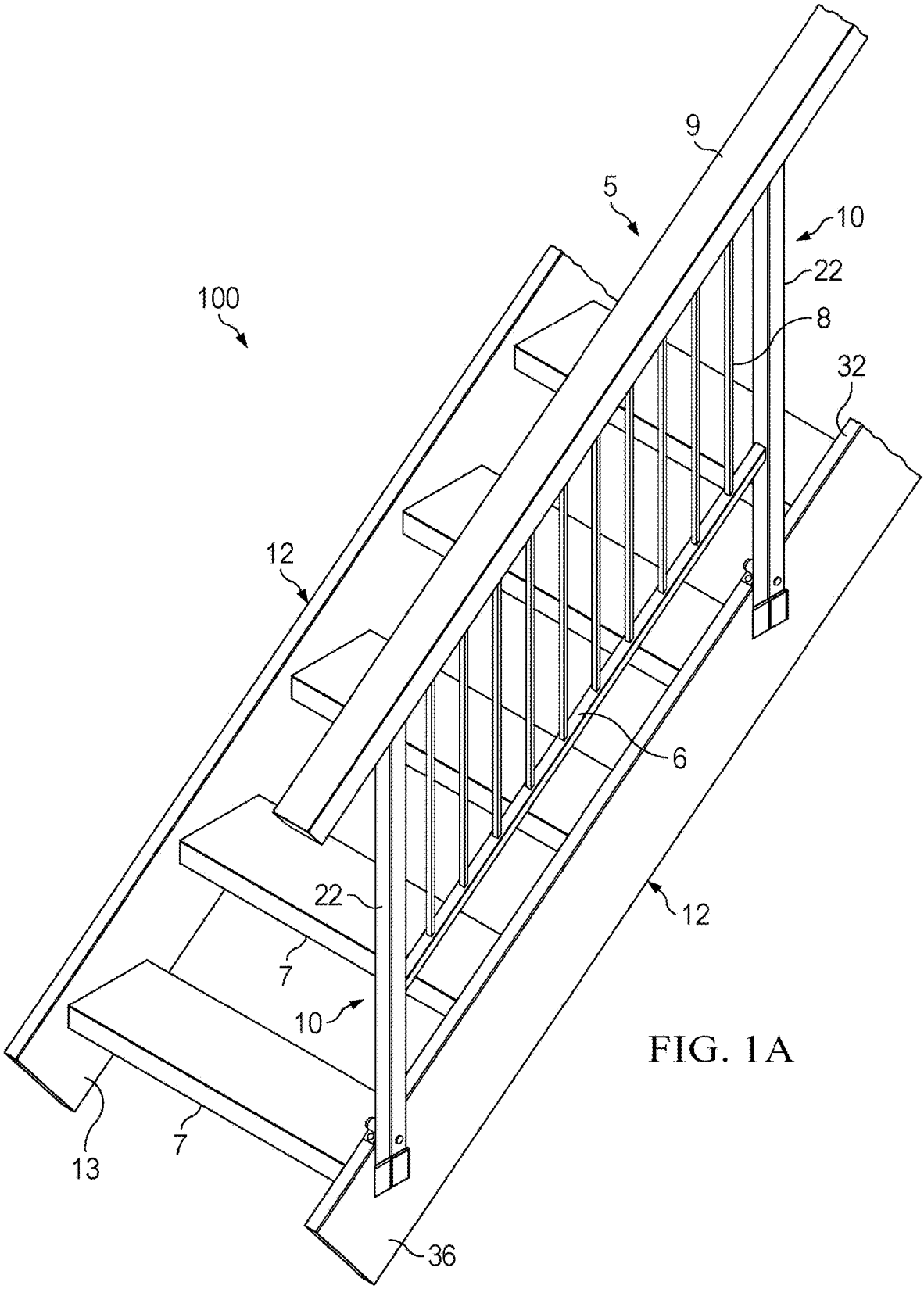
FIG. 1A is a perspective view of an embodiment of the adjustable stair railing post assembly attached to a box shaped stringer.
Figure 1B:
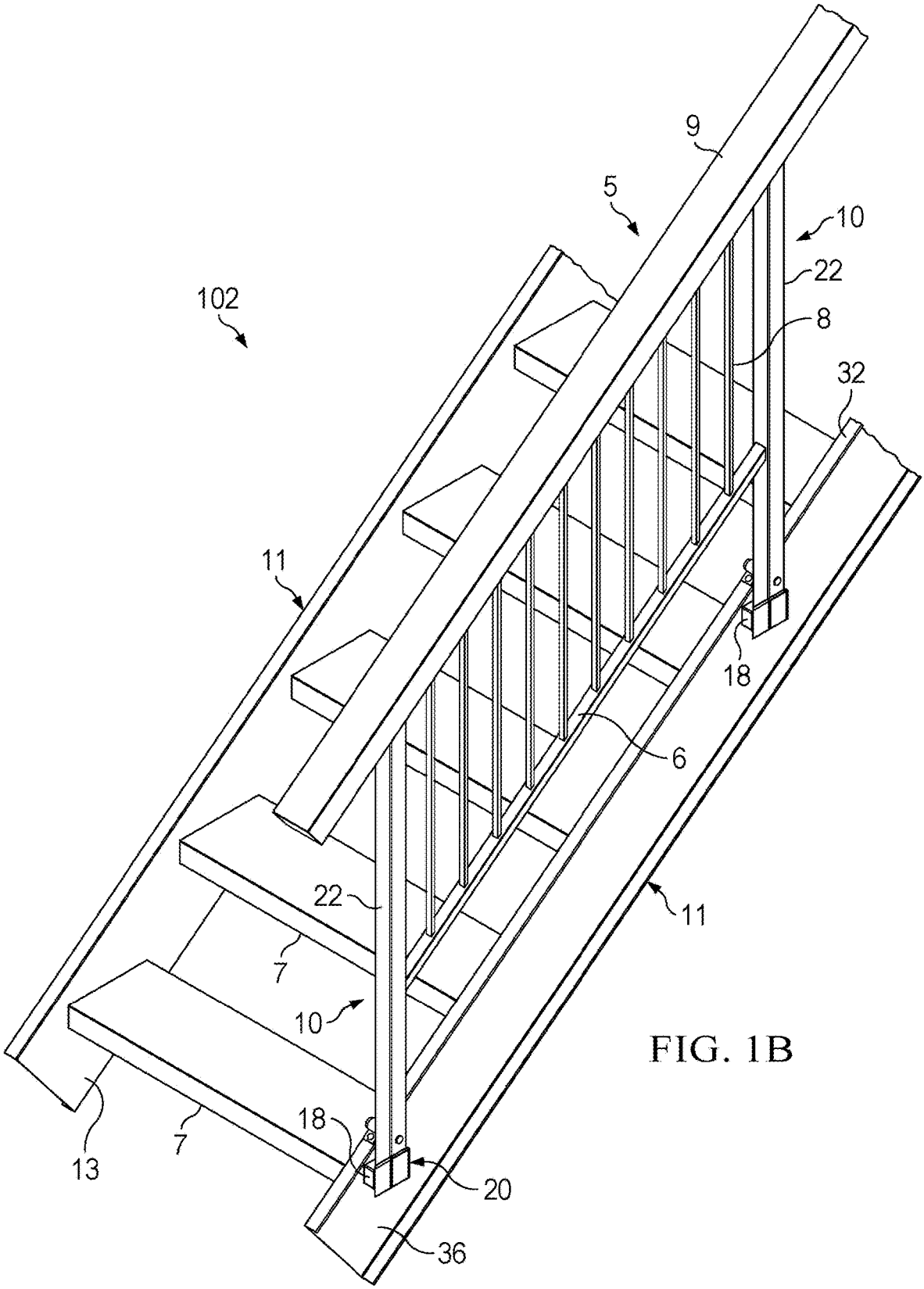
FIG. 1B is a perspective view of an embodiment of the adjustable stair railing post assembly supporting a rail panel. The adjustable stair railing post assembly is attached to a channel, C-shaped stringer.

FIGS. 1A and 1B are perspective views of stair assemblies 100 and 102, respectively, that each employs an embodiment of an adjustable post assembly 10 according to the teachings of the present disclosure. FIG. 1A illustrates stair assembly 100, which includes stringers 12 formed of box-shaped, tube channels. FIG. 1B illustrates a stair assembly 102, which includes stringers 11 formed of C-channels.

The stair assembly 100 includes a pair of stringers 12 disposed spaced apart from each other. The stair assembly 102 includes a pair of stringers 11 disposed spaced apart from each other. Each of the stair assemblies 100, 102 includes a plurality of stair treads 7 that are supported by the stringers 11, 12. According to an embodiment, each stair tread 7 may be secured to a lateral wall 13 (also referred to as a side wall) of each stringer 11, 12. In this type of stair configuration, the post portions 22 supporting the rail panel 5 are supported by the stringers 11, 12.

The rail panel 5 may be an adjustable rail panel including a pair of spaced apart rails 6 that support a plurality of balusters or pickets 8. The joint between the balusters 8 and each rail 6 may be hinged or otherwise adjustable to allow the rails 6 to follow a range of stair angles, while the balusters 8 remain vertical. In the illustrated embodiment, the rail panel 5 supports an accent rail 9, which may be sized and shaped to be easily gripped to serve as a handrail. This disclosure also contemplates a rail panel without an accent handrail.

The adjustable post assembly 10 according to the present disclosure accommodates a range of incline angles of the stair assemblies 100, 102, or more specifically the incline angles of the stringers 11, 12. The adjustable post assembly 10 may also be referred to as an adjustable stair stringer post. The adjustable post assembly 10 mounts to the stringer 11 or 12 and is pivotable over a range of incline angles to maintain a railing support post portion 22 in a vertical, upright orientation. For example, an embodiment of the adjustable post assembly 10 can accommodate stringer angles of 0-50 degrees. For example, the adjustable post assembly 10 may accommodate a stringer incline angle of 10 degrees to 40 degrees.

The adjustable post assembly 10 may be mounted to stringers 11, 12 oriented at incline angles of 30-50 degrees measured from horizontal. According to an alternate embodiment, the adjustable post assembly 10 maintains the post in an upright, vertical orientation independent of the angle of inclination of the stairway and the stringer. According to an embodiment, the adjustable post assembly 10 includes a pivot rod 16 (see FIGS. 2B and 4) that is configured to roll, rotate, or pivot, on an upper wall 32 of a stair stringer 11 or 12. Since the pivot rod 16 is secured to the post assembly 10, the rotational movement of the post assembly 10 corresponds to the rotational movement of the pivot rod 16. In this manner, the adjustable post assembly 10 can be pivoted to be mounted to maintain the post portion 22 in a vertical orientation when mounted to a stringer 12 that forms a nonperpendicular angle relative to the horizontal.

In FIGS. 1A and 1B, only two post assemblies 10 are shown supporting a rail panel 5, but stair stringers 11 or 12 can support any number of adjustable post assemblies 10 such that the full length of the stair stringer 12 supports a railing. An opposite stringer 11 or 12 may also include adjustable post assemblies 10 supporting a railing (not shown). According to an alternate embodiment, the stair assembly 100 may be constructed with only one stringer 11, 12, and the other side of the steps may be supported by a structure, such as a wall of a house.

As discussed in more detail below, the stair support stringers 12 may be box-shaped, tube stringers (see FIGS. 1A, 2A, and 2B) or alternatively may be channel stringers 11, having a "C" shape (see FIGS. 1B and 3). The channel stringer 11 embodiment employs a spacer 18 to properly position the post portion 22 upright with respect to the channel portion of the stringer 11.

Referring to FIG. 1B, which illustrates an embodiment similar to the one shown in FIG. 1A with the addition of the spacer 18. The post assembly 10 of the present embodiment is secured to a stair stringer 11 that is in the form of a C-channel. The stair stringer 12 may be formed of metal, for example steel. In some embodiments, a C-channel stair stringer 11 supports the adjustable post assembly 10 using a standoff support or spacer 18 to allow the post assembly 10 to be secured to the single vertical wall 36 of the C-channel. In this embodiment, the stair tread 7 is attached to the same lateral wall 36 as the post assembly 10. The spacer 18 allows for the post assembly 10 to be installed on a C-channel type stringer 11. In another embodiment utilizing a C-channel stringer 11, the spacer 18 can be omitted if the orientation of the C-channel is flipped such that the stair treads are on the channel side or inner side of the stringer 12.

Figure 2A:
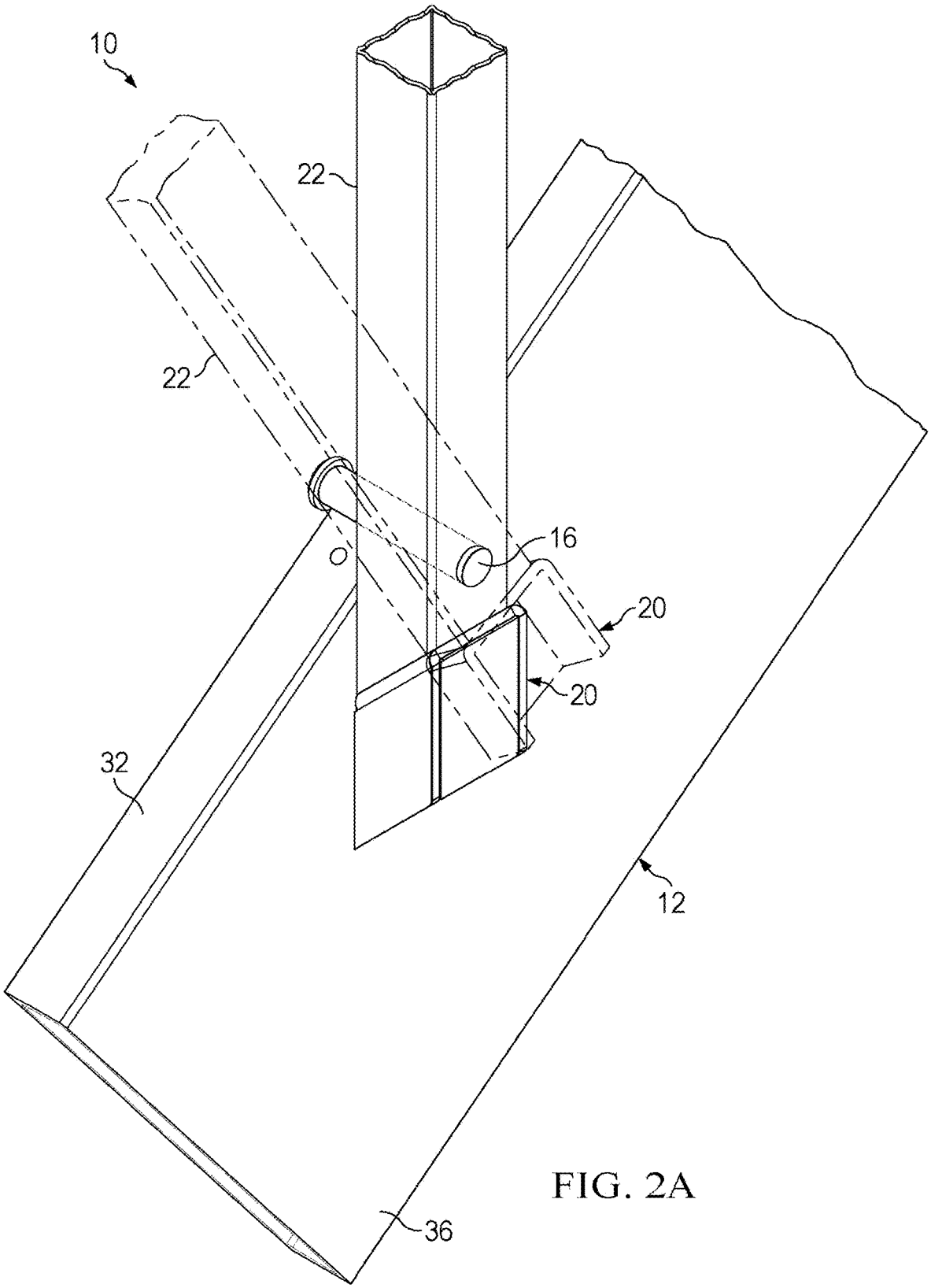
FIG. 2A is a detailed view of an embodiment of the adjustable post assembly being mounted to a box shaped stair stringer and illustrating positions for mounting at multiple different incline angles of the stringer.
Figure 2B:
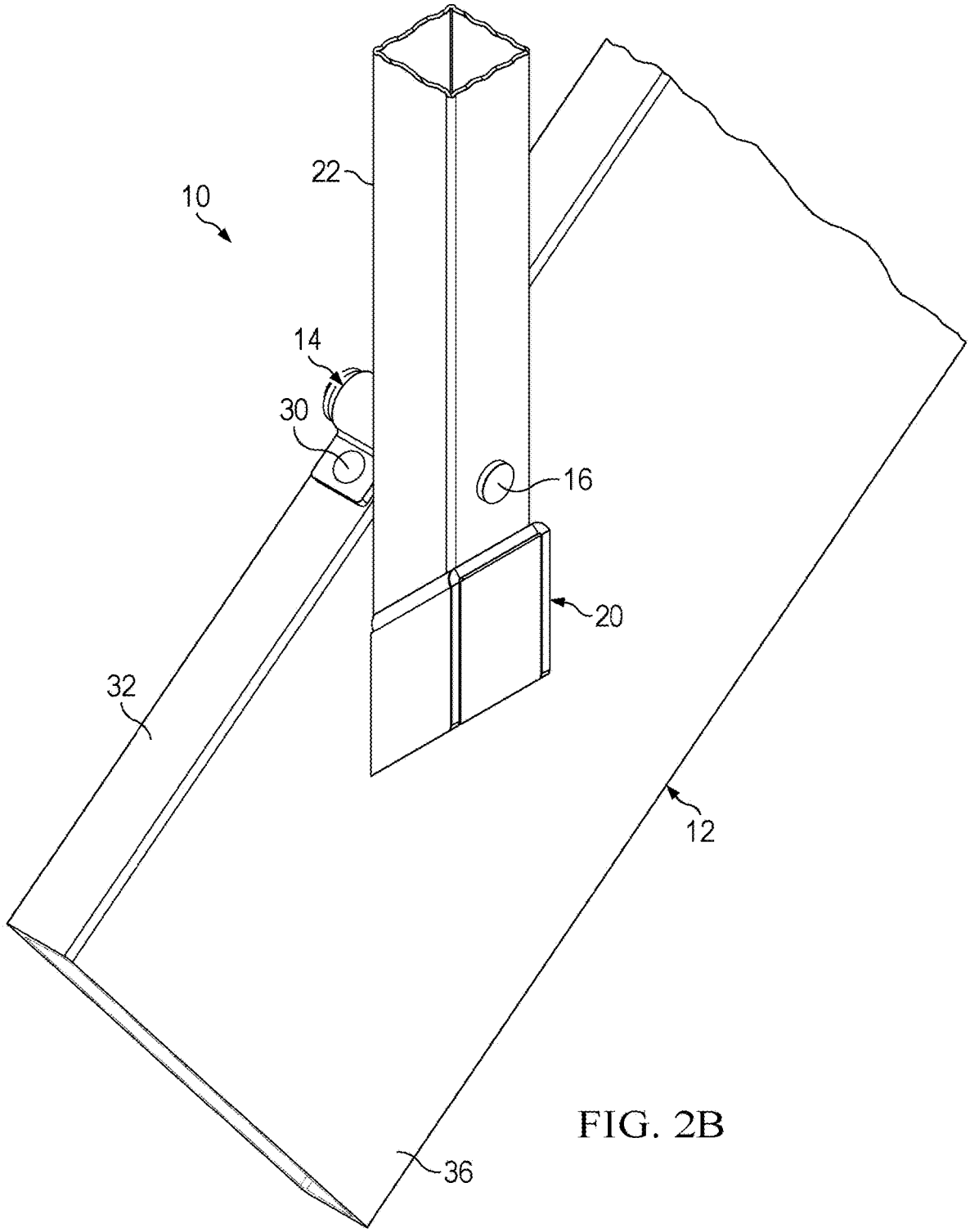
FIG. 2B is a detailed view of an embodiment of the adjustable post assembly mounted to a box shaped stair stringer.

FIGS. 2A and 2B illustrate detail views of the embodiment shown in FIG. 1A. Particularly, shown are the stringer 12 and the post assembly 10, which includes a post portion 22 (i.e. upright or vertical member), a pivot rod 16, and a base portion 20. FIG. 2A shows multiple positions of the adjustable post assembly 10 illustrating the angle adjustability of the adjustable post assembly 10. For example, the position of the adjustable post assembly 10 shown in broken lines may correspond to a gradual incline angle, for example 33 degrees. The same adjustable post assembly 10 may also be used with a stringer 12 oriented at a steeper incline angle, for example 38 degrees. The adjustable post assembly 10 mounted to a stringer 12 at a steeper incline angle is illustrated by the adjustable post assembly 10 shown in solid lines in FIG. 2A. The angle adjustability is facilitated by pivoting or rolling the pivot rod 16 on the upper wall 32 of the stringer 12. In this manner, the same adjustable post assembly 10 may be mounted to stair stringers 12 oriented at multiple incline angles and maintain the post portion 22 vertical and upright.

The angle adjustability illustrated in FIG. 2A applies to the C-channel stringer 11 shown in FIG. 1B. In this embodiment, the pivot rod 16 pivots or rolls on the upper wall 32 of the C-channel stringer 11.

In the illustrated embodiment, the base portion 20 is attached directly to a lateral wall 36 of the stringer 12. In FIG. 2B, the top bracket 14 is shown fastened to the upper wall 32 of the stringer 12 with a fasteners 30 (only one fastener 30 shown). According to an embodiment, the fasteners 30 may be self-tapping to secure to the upper wall 32 of the stringer 12. In another embodiment, the fasteners 30 could be bolts that sit in a set of holes drilled through the height of the stringer 12 with a nut or other suitable fastener retaining the bolt on the underside of the stringer 12.

Figure 3:
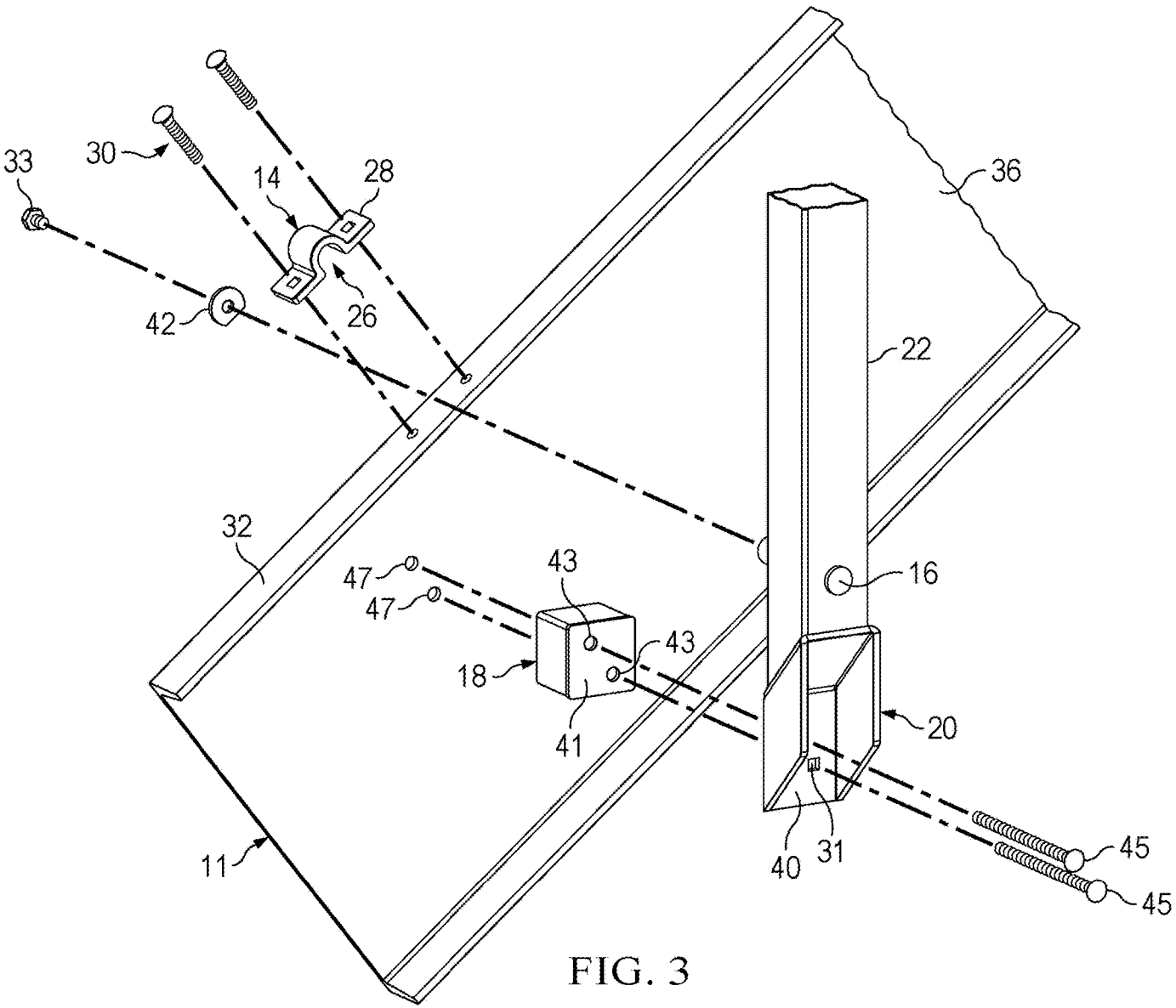
FIG. 3 is an exploded view of an embodiment of the lower end of the adjustable post assembly illustrating attachment to the stair stringer.

Reference is now made to FIG. 3, which illustrates an exploded view of an embodiment of the adjustable post assembly 10. The illustrated embodiment shows the C-channel stringer 11, the post portion 22, the pivot rod 16, the spacer 18, the base portion 20, and the top bracket 14 with an arcuate portion 26.

According to an embodiment, the post portion 22 is box shaped with a rectangular cross section. According to one embodiment, the post portion 22 may be formed of 2 inch square tubing. According to an alternate embodiment, the post portion may be formed of 3 inch square tubing. Alternatively, the post portion 22 can have any suitable shape or outer profile, for example the post portion 22 may be cylindrical.

Figure 4:
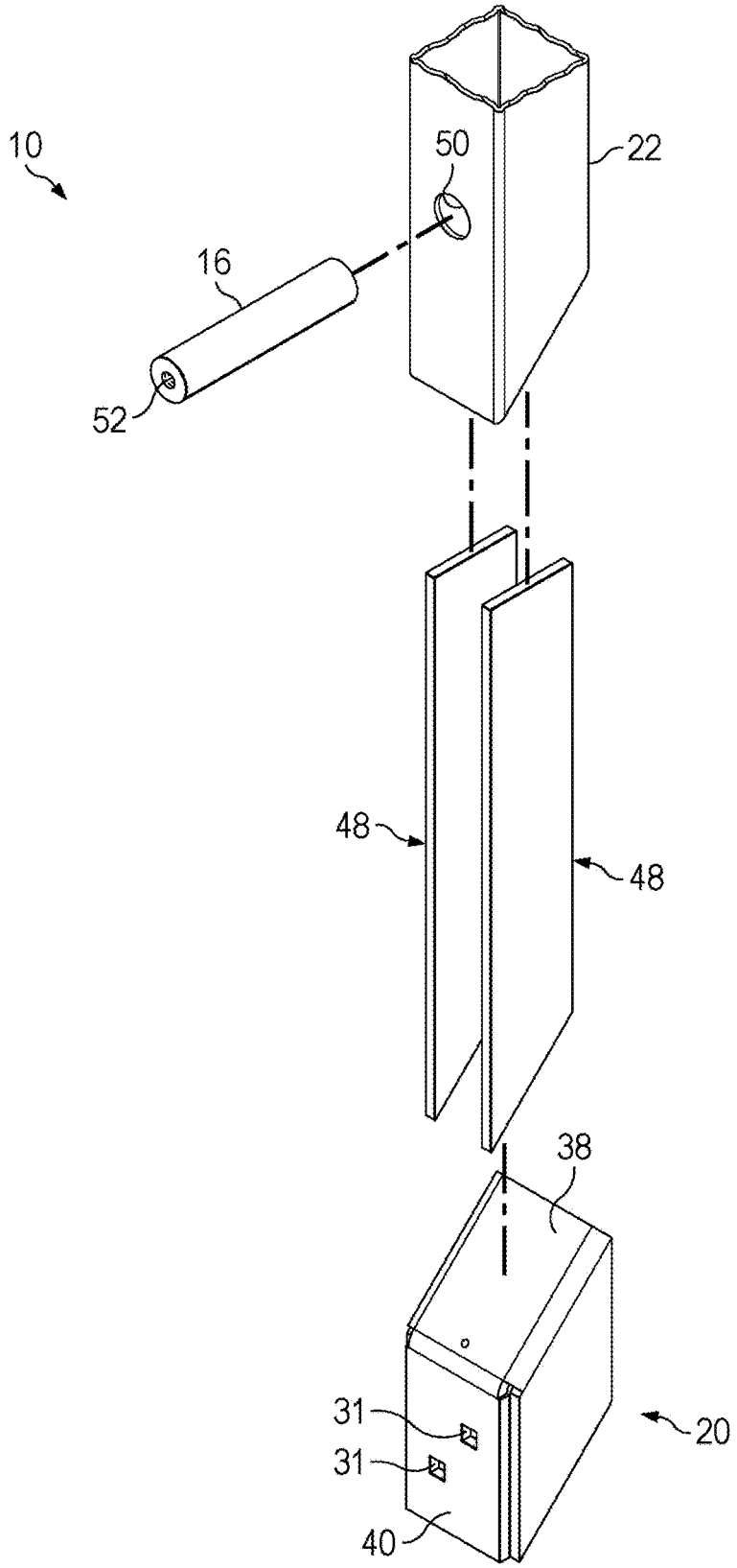
FIG. 4 is an exploded view of an embodiment of the adjustable post assembly.

The post portion 22 may include a through hole 50 for the pivot rod 16 where the pivot rod 16 is welded to the circumference of the through hole (see FIG. 4). In another embodiment, the pivot rod 16 can be secured to the post portion 22 by welding the pivot rod 16 directly to a face of the post portion 22. Such welding can utilize metal inert gas ("MIG") welding, arc welding, tungsten inert gas ("TIG") welding, also known as gas tungsten arc welding ("GTAW"), or any other suitable form or technique of welding.

According to the illustrated embodiment, the adjustable post assembly 10 is secured to the stringer 11 using conventional fasteners, as opposed to welding. Home owners and contractors can use conventional fasteners to construct a stairway railing for an outdoor deck, which are more accessible and easier to use than welding. According to an embodiment, carriage bolts of a suitable length and diameter are used to secure the base portion 20 to the lateral wall 36 of the stringer 11.

According to the illustrated embodiment, a stop member 42 can secure the pivot rod 16. The stop member 42 can be any suitable shape such that it prevents the pivot rod 16 from laterally exiting the top bracket 14. The stop member 42 reinforces the adjustable post assembly 10 to withstand a force perpendicular to the plane of the rail panel 5 that may create a moment/torque on the bracket that may tend to cause the post to dislodge from the stringer 11, 12 in a direction parallel to the axis of the pivot rod 16.

In the present embodiment, the stop member 42 is a washer secured to the pivot rod 16 by a fastener 33. The stop member 42 can be made such that the stop member 42 can be secured by the fastener 33 that is threaded into a threaded bore 52 (see FIG. 4) in the pivot rod 16 to prevent lateral movement of the pivot rod 16. According to an embodiment, the stop member 42 may include a flat portion to provide clearance for the upper wall of the stringer. The stop member 42 can be made of any suitable material including, but not limited to, plastics such as rigid polymeric, polymer composite, high-density polyethylene, polyethylene, polypropylene, or any other plastic material. Similarly, in other embodiments the pivot rod 16 is manufactured using metals such as, iron, carbon steel, stainless steel, aluminum, or any other suitable material.

According to another embodiment, the pivot rod 16 is shaped such that it does not require a separate stop member 42. The pivot rod 16 can be formed such that it includes a distal end that is bulbous or has an enlarged diameter to that of the portion of the pivot rod 16 sandwiched by the arcuate portion 26 of the top bracket 14. In this embodiment, the enlarged distal portion of the pivot rod 16 constrains the pivot rod 16 from laterally exiting or sliding out of the arcuate portion 26 of the top bracket 14.

In another embodiment, the pivot rod 16 has an enlarged head that has a larger diameter than the through hole in the post portion 22. In this embodiment, the stop member 42 constrains the lateral movement of the pivot rod 16 in one direction and the enlarged head of the pivot rod 16 constrains the lateral movement in the opposite direction.

According to an embodiment, the spacer 18 may be formed of sheet metal formed into a hollow box-shaped structure with at least one face open. A rear wall 41 of the spacer 18 defines a plurality of through holes 43 configured to receive fasteners 45, such as carriage bolts. The through holes 43 are configured to align with corresponding through holes 47 in the side wall 36 of the stringer 11 and the through holes 31 of the base portion 20. The through holes 47 may be preformed or drilled after measuring and properly marking their location at the jobsite. The bolts 45 receive nuts on their threaded ends disposed on an opposite side of the lateral wall 36 of the stringer 11.

In an alternate embodiment, the spacer 18 can be a solid block of suitable thickness with holes drilled through to accommodate fasteners to secure the spacer 18 to the stringer 11. In yet another embodiment, the spacer 18 is a plurality of washers that collectively have the same or substantially similar thickness to a solid spacer 18. The spacer 18 can be manufactured using any material choice of any of the components disclosed herein. The spacer 18 can be secured to the stringer 11 by any suitable method, including but not limited to, fasteners, MIG welding, arc welding, TIG welding, epoxy, or any other suitable means of securing the spacer 18 to the stringer 11. According to the illustrated embodiment, the spacer 18 is secured between the side wall 36 of the stringer 11 and the base portion 20 using conventional fasteners, as opposed to welding.

The stringers 11, 12 may have any suitable shape. According to one embodiment, the stringers 12 are tubular with a rectangular cross section. The stringers 11 may be in the form of a C-channel. The stringers 11, 12 may be formed of 16-gauge steel or other suitable type of metal or thickness. The upper wall 32 can be used to secure the top bracket 14 to the stringer 11, 12. According to some embodiments, the stringers 11, 12 are formed by conventional sheet metal forming techniques, such as roll forming or press brake forming.

The top bracket 14 includes an arcuate portion 26 that corresponds to the size and shape of the pivot rod 16. A pair of flanges 28 extends from each side of the arcuate portion 26. The flanges 28 include through holes to receive a fastener 30 to fasten the top bracket 14 to the stair stringer 12 with the pivot rod 16 disposed between the upper wall 32 of the stair stringer 12 and the arcuate portion 26 of the top bracket 14. According to an embodiment, the top bracket 14 is a unitary body that may be formed by bending and punching a blank of sheet metal. The top bracket may be generally U-shaped and similar to a pipe strap in form and function. The sheet metal may be aluminum, carbon steel, stainless steel, or any other suitable metal. According to an alternate embodiment, the top bracket 14 may be formed of a rigid polymeric, polymer composite, high-density polyethylene, polyethylene, polypropylene, or any other plastic material.

Referring now to FIG. 4, which illustrates an exploded view of the adjustable post assembly 10 according to the present disclosure. In this illustrated embodiment, a pair of reinforcing bars 48 reinforces the junction of the base portion 20 and the post portion 22. The reinforcing bars 48 add strength to the lower portion of the post, which may be subject to high moments if a force is applied perpendicular to the plane of the rail panel 5. This may occur if an individual slips traversing the stairs and falls against the rail panel. It is important that the posts and the panel withstand this force and do not fail such that the railing dislodges from the stairway. The reinforcing bars 48 may be welded to a top wall 38 of the base portion 20. The reinforcing bars 48 are then inserted into the hollow portion of the post portion 22. The reinforcing bars 48 may be spaced apart to allow the pivot rod 16 to be received between the reinforcing bars 48. The base portion 20 may be welded to the post portion 22 to secure the base portion 20 to the post portion 22. According to an alternate embodiment, the reinforcing bars 48 may be omitted.

The post portion 22 can be reinforced with a reinforcing bar 48 in areas where the post portion 22 may experience high stress or loading of an external force. The reinforcing bar 48 can be a single reinforcing bar 48 or a plurality of reinforcing bars 48. The reinforcing bar 48 can be made of any suitable material, in one embodiment the reinforcing bar 48 is made of carbon steel. In other embodiments, the reinforcing bar 48 is made of metals that include, but not limited to, stainless steel, iron, or aluminum.

In yet another embodiment, the reinforcing bar 48 can be secured to an internal surface of the post portion 22. In another embodiment, the reinforcing bar 48 can be secured to an external surface of the post portion 22. The reinforcing bar 48 can be secured or attached to the post portion 22 by any suitable method, including but not limited to, welding, fasteners, or epoxy.

In an embodiment, the base portion 20 includes a top wall 38 and a front wall 40 that extends from the top wall 38. In an embodiment, the top wall 38 of the base portion 20 is set at an angle relative to the front wall 40. Similarly, the reinforcing bar 48 can be manufactured to have an end profile that matches the angle of the top wall 38 of the base portion 20.

The front wall 40 may include through holes 31 such that the base portion 20 can be secured to a stringer 11, 12 with fasteners 45. The front wall 40 can be attached or secured to the stringer 11, 12 by any suitable method including, but in no way limited to, fasteners, self-tapping screws, epoxy, MIG welding, arc welding, or TIG welding. The base portion 20 can be made of any suitable material and can be made of the same material as any other component disclosed herein.

An exemplary method for installing the post assembly 10 onto a stringer 12 is setting the pivot rod 16 on the upper wall 32 and marking a location on the lateral wall 36 for the bolt holes 47. The post assembly 10 is rotated on the pivot rod 16 to position the post portion 22 in an upright, vertical orientation. Holes are marked as needed in the stringer 12 and then drilled. The front wall 40 of the base portion 20 is abutted to the lateral wall 36 of the stringer 12 and secured thereto with fasteners 45, spot welds, or any other suitable method. The top bracket 14 is secured with fasteners 30 over the pivot rod to constrain any possible movement of the pivot rod 16 along the upper wall 32.

For example, carriage bolts 45 are received through the through holes 47 and the square-shaped neck of the carriage bolts 45 engage the corresponding square-shaped through holes 31 in the front wall 40 of the base portion 20 to prevent rotation of the bolts 45 when they are fastened with a washer and nut on the stair side of the stringer 12.

According to the present disclosure, the C-channel stringer 11 supports the adjustable post assembly 10 with the spacer 18 positioned secured between the lateral wall 36 of the stringer 11 and the front face wall 40 of the base portion 20. Carriage bolts 45 are received through the through holes 47 and through the holes 43 in the spacer 18. The square-shaped neck of the carriage bolts 45 engage the corresponding square-shaped through holes 31 to prevent rotation of the bolt when they are fastened with a washer and nut on the stair side of the stringer 11.

As used herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the figures. It should be noted that the orientation of various elements may differ according to other exemplary embodiments, and that such variations are intended to be encompassed by the present disclosure.

Although the figures and description may illustrate a specific order of method steps, the order of such steps may differ from what is described, unless specified differently above. Also, two or more steps may be performed concurrently or with partial concurrence, unless specified differently above. All such variations are within the scope of the disclosure.

It is important to note that the construction and arrangement of the assemblies as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. An adjustable stair system, comprising:

a stringer comprising a lateral wall and an upper wall, the stringer being configured to support a plurality of stair treads; and a rail panel configured to be supported by an adjustable post assembly, the adjustable post assembly being configured to be supported by the stringer and, comprising:

a post portion being a generally hollow rectangular tube;

a pivot rod extending laterally from the post portion, the pivot rod configured to be supported by the upper wall of the stringer, the pivot rod being cylindrical to allow pivoting adjustment to position the post portion in a vertical orientation for multiple incline angles of the stringer;

a base portion being configured to couple to the lateral wall of the stringer and defining a plurality of first through holes, each configured to receive a first fastener; and a top bracket having an arcuate portion sized and shaped to correspond to a circumference of the pivot rod, the top bracket defining a pair of second through holes, each configured to receive a second fastener.

2. The adjustable stair system of claim 1 wherein the stringer is a tube stringer having a box-shape and the lateral wall comprises a first lateral wall and a second lateral wall disposed opposite the first lateral wall, wherein the first lateral wall is configured to couple to the plurality of stair treads and the adjustable post assembly is configured to couple to the second lateral wall.

3. The adjustable stair system of claim 1 wherein the stringer is a channel stringer having a C-shape.

4. The adjustable stair system of claim 3 further comprising a spacer configured to abut the lateral wall of the stringer and abut the base portion, the spacer comprising a front wall defining a plurality of third through holes configured to receive the first fasteners.

5. The adjustable stair system of claim 1 wherein the post portion has a square-shape in cross section.

6. The adjustable stair system of claim 1 wherein the multiple incline angles include a range of 30-50 degrees measured from a horizontal plane.

7. The adjustable stair system of claim 1 wherein the adjustable post assembly comprises a first adjustable post assembly and a second adjustable post assembly, the rail panel being configured to be supported at a first end by the first adjustable post assembly and at a second end opposite the first end by the second adjustable post assembly.

8. The adjustable stair system of claim 1 wherein the pivot rod is welded to the post portion.

9. The adjustable stair system of claim 1 wherein the pivot rod includes a threaded bore and further comprising a washer configured to be disposed between a head of a third fastener received in the threaded bore and the top bracket.

10. The adjustable stair system of claim 1 wherein the pivot rod includes an enlarged diameter portion disposed at a distal end of the pivot rod.

11. The adjustable stair system of claim 1 wherein the base portion includes an upper wall, a front wall, and a pair of opposed side walls, the front wall defining the plurality of first through holes and the upper wall of the base portion being welded to the post portion.

12. The adjustable stair system of claim 11 further comprising a pair of reinforcing bars welded to the upper wall of the base portion and received by the post portion.

13. An angle-adjustable post assembly for supporting a rail panel, comprising:

a post portion being a generally hollow rectangular tube;

a pivot rod extending laterally from the post portion, the pivot rod being cylindrical to allow pivoting adjustment to position the post portion in a vertical orientation for multiple incline angles;

a base portion defining a plurality of first through holes, each configured to receive a first fastener;

a top bracket having an arcuate portion sized and shaped to correspond to a circumference of the pivot rod, the top bracket defining a pair of second through holes, each configured to receive a second fastener; and a spacer configured to abut the base portion, the spacer comprising a front wall defining a plurality of third through holes configured to receive the first fasteners.

14. The angle-adjustable post assembly of claim 13 wherein the post portion has a square-shape in cross section.

15. The angle-adjustable post assembly of claim 13 wherein the multiple incline angles include a range of 30-50 degrees measured from a horizontal plane.

16. The angle-adjustable post assembly of claim 13 wherein the pivot rod includes a threaded bore and further comprising a washer configured to be disposed between a head of a third fastener received in the threaded bore and the top bracket.

17. The angle-adjustable post assembly of claim 13, wherein the pivot rod is welded to the post portion.

18. An angle-adjustable post assembly for supporting a rail panel, comprising:

a post portion being a generally hollow rectangular tube having a face wall;

a pivot rod extending laterally from the face wall and welded to the post portion, the pivot rod being cylindrical to allow pivoting adjustment to position the post portion in a vertical orientation for multiple incline angles;

a base portion defining a plurality of first through holes, each configured to receive a first fastener;

a pair of reinforcing bars welded to the base portion and received by the post portion; and a top bracket having an arcuate portion sized and shaped to correspond to a circumference of the pivot rod, the top bracket defining a pair of second through holes, each configured to receive a second fastener.

19. The angle-adjustable post assembly of claim 18 further comprising a spacer configured to abut the base portion, the spacer comprising a front wall defining a plurality of third through holes configured to receive the first fasteners.

20. The angle-adjustable post assembly of claim 18 wherein the pivot rod includes a threaded bore and further comprising a washer configured to be disposed between a head of a third fastener received in the threaded bore and the top bracket.

* * * * *